US009022792B2

(12) United States Patent
Sticker et al.

(10) Patent No.: US 9,022,792 B2
(45) Date of Patent: May 5, 2015

(54) SHIELD CONTACT SPRING

(75) Inventors: Rolf Sticker, Blumberg (DE); Werner Rösch, Blumberg (DE)

(73) Assignee: MCQ Tech GmbH, Blumberg (DE)

( * ) Notice: Subject to any disclaimer, the term of this patent is extended or adjusted under 35 U.S.C. 154(b) by 136 days.

(21) Appl. No.: 13/814,995

(22) PCT Filed: Mar. 7, 2012

(86) PCT No.: PCT/EP2012/001005

§ 371 (c)(1),
(2), (4) Date: Mar. 27, 2013

(87) PCT Pub. No.: WO2012/146334

PCT Pub. Date: Nov. 1, 2012

(65) Prior Publication Data

US 2013/0203291 A1 Aug. 8, 2013

(30) Foreign Application Priority Data

Apr. 28, 2011 (DE) ..... 10 2011 018 993

(51) Int. Cl.

| | |
|---|---|
| ***H01R 4/66*** | (2006.01) |
| ***H01R 13/6592*** | (2011.01) |
| ***H01R 9/05*** | (2006.01) |
| ***H01R 13/6583*** | (2011.01) |

(52) U.S. Cl.
CPC ..... *H01R 13/6592* (2013.01); *H01R 9/0527* (2013.01); *H01R 13/6583* (2013.01)

(58) Field of Classification Search
CPC ..... H01R 13/658; H01R 13/506; H01R 13/65802; H01R 13/648; H01R 9/032
USPC ..... 439/98, 607.41, 607.44
See application file for complete search history.

(56) References Cited

U.S. PATENT DOCUMENTS

| | | | | |
|---|---|---|---|---|
| 1,793,884 | A * | 2/1931 | Church | 285/195 |
| 2,682,646 | A * | 6/1954 | Hubbell | 439/97 |
| 2,744,769 | A * | 5/1956 | Roeder et al. | 285/149.1 |
| 2,749,434 | A * | 6/1956 | Falge | 362/546 |
| 3,144,292 | A * | 8/1964 | Forney, Jr. | 439/607.52 |
| 3,609,632 | A * | 9/1971 | Vetter | 439/258 |
| 3,678,445 | A * | 7/1972 | Brancaleone | 439/607.17 |
| 4,423,919 | A * | 1/1984 | Hillis | 439/607.17 |
| 4,739,126 | A * | 4/1988 | Gutter et al. | 174/78 |

(Continued)

FOREIGN PATENT DOCUMENTS

| | | | |
|---|---|---|---|
| DE | 37 12 693 | A1 | 4/1987 |
| DE | 10 2006 010279 | A1 | 3/2006 |

(Continued)

*Primary Examiner* — Abdullah Riyami
*Assistant Examiner* — Vladimir Imas
(74) *Attorney, Agent, or Firm* — Juneau & Mitchell

(57) ABSTRACT

The invention relates to a shield contact spring having a contact spring for the purpose of contacting a shield of a cable being connected, and having a fixing spring for the purpose of fixing the shield contact spring in a position in which the contact spring abuts the shield of the cable being connected, wherein the contact spring has a first end and a second end, and wherein the fixing spring has a first end and a second end, wherein the contact spring and the fixing spring are connected to each other by their first ends via a U-shaped connection region, wherein the shield contact spring has a support spring for the purpose of pressing out the contact spring from the insertion region of the cable being connected, upon the insertion of the shield contact spring into a housing.

10 Claims, 4 Drawing Sheets

(56) References Cited

U.S. PATENT DOCUMENTS

| | | | | | |
|---|---|---|---|---|---|
| 4,970,350 | A * | 11/1990 | Harrington | 174/661 |
| 5,017,158 | A * | 5/1991 | Liu et al. | 439/607.23 |
| 5,278,352 | A * | 1/1994 | Schade | 174/653 |
| 5,580,278 | A * | 12/1996 | Fowler et al. | 439/607.23 |
| 5,691,506 | A * | 11/1997 | Miyazaki et al. | 174/652 |
| 5,702,262 | A * | 12/1997 | Brown et al. | 439/188 |
| 5,731,543 | A * | 3/1998 | Jorgensen | 174/661 |
| 5,814,769 | A * | 9/1998 | Karlstrom et al. | 174/117 F |
| 5,899,769 | A * | 5/1999 | Konetschny et al. | 439/394 |
| 5,949,020 | A * | 9/1999 | Mitchell et al. | 174/40 CC |
| 5,964,607 | A * | 10/1999 | Finke et al. | 439/188 |
| 6,012,932 | A * | 1/2000 | Vanbesien | 439/101 |
| 6,020,557 | A * | 2/2000 | Jorgensen | 174/660 |
| 6,042,396 | A * | 3/2000 | Endo et al. | 439/98 |
| 6,188,171 | B1 * | 2/2001 | Hamm | 313/407 |
| 6,402,553 | B1 * | 6/2002 | Schwarz et al. | 439/607.58 |
| 6,514,104 | B1 * | 2/2003 | Lazaro, Jr. | 439/607.18 |
| 6,986,683 | B2 * | 1/2006 | Lazaro, Jr. | 439/607.18 |
| 7,011,544 | B1 * | 3/2006 | Zemba | 439/578 |
| 7,018,220 | B2 * | 3/2006 | Zemba | 439/98 |
| 7,044,756 | B1 * | 5/2006 | Asakura et al. | 439/98 |
| 7,154,054 | B1 * | 12/2006 | Gretz | 174/655 |
| 7,244,131 | B1 * | 7/2007 | Khemakhem et al. | 439/188 |
| 7,247,052 | B2 * | 7/2007 | Sofker | 439/607.01 |
| 7,335,029 | B2 * | 2/2008 | Backeralf et al. | 439/67 |
| 7,390,979 | B1 * | 6/2008 | Johnson | 174/655 |
| 7,470,133 | B2 * | 12/2008 | Khemakhem et al. | 439/188 |
| 7,540,772 | B2 * | 6/2009 | Sardi et al. | 439/581 |
| 7,576,290 | B1 * | 8/2009 | Korcz | 174/655 |
| 7,892,026 | B2 * | 2/2011 | Langhoff et al. | 439/607.02 |
| 7,918,684 | B2 * | 4/2011 | Lu | 439/395 |
| 7,955,131 | B2 * | 6/2011 | Barbier et al. | 439/607.17 |
| 8,147,272 | B2 * | 4/2012 | Rhein | 439/556 |
| 8,506,325 | B2 * | 8/2013 | Malloy et al. | 439/578 |
| 8,535,094 | B2 * | 9/2013 | Youn et al. | 439/607.17 |
| 8,556,649 | B2 * | 10/2013 | Nolting et al. | 439/455 |
| 8,777,658 | B2 * | 7/2014 | Holland et al. | 439/578 |
| 8,814,598 | B2 * | 8/2014 | Hein et al. | 439/607.41 |
| 2007/0163804 | A1 * | 7/2007 | Auray et al. | 174/666 |

FOREIGN PATENT DOCUMENTS

| | | | |
|---|---|---|---|
| DE | 10 2007 025 023 | A1 | 5/2007 |
| DE | 10 2008 061 268 | A1 | 12/2008 |
| EP | 1 022 836 | A2 | 4/1997 |
| EP | 0 844 694 | B1 | 10/1997 |
| EP | 1 126 548 | A2 | 11/1997 |

* cited by examiner

SHIELD CONTACT SPRING

CROSS REFERENCE TO RELATED APPLICATIONS

This patent application claims priority to International Patent Application PCT/EP2012/001005, filed on Mar. 7, 2012 and thereby to German Patent Application 10 2011 018 993.9, filed on Apr. 28, 2011.

STATEMENT REGARDING FEDERALLY SPONSORED RESEARCH OR DEVELOPMENT

No federal government funds were used in researching or developing this invention.

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

Field and Background of the Invention

The invention relates to a shield contact spring having a contact spring for the purpose of contacting a shield of a cable being connected, and having a fixing spring for the purpose of fixing the shield contact spring in a position.

Shield contact springs are known for the purpose of connecting a shield of a cable, in an electrically conductive manner, to the housing or to the shield of the housing of the plug socket into which the cable is being connected. Shield contact springs are known which have a contact spring for the purpose of contacting a shield of a cable being connected, and which have a fixing spring for fixing the shield contact spring in a position in which the contact spring abuts the shield of the cable being connected, wherein the contact spring has a first end and a second end, and wherein the fixing spring has a first end and a second end, and wherein the contact spring and the fixing spring are connected on their first ends via a U-shaped connection region. When the shield contact spring is arranged in the housing of the plug, the shield contact spring is arranged to be able to pivot in the housing about the U-shaped connection region. After the insertion of the cable, the same being connected, into an insertion region, the shield contact spring is fixed by means of the fixing spring in a position in which the contact spring abuts the shield of the cable being connected. The electrically conductive contact to the shield of the housing or to the housing of the plug is realized via the contact spring.

The problem addressed by the invention is that of simplifying the operation of the shield contact spring for the user.

BRIEF SUMMARY OF THE INVENTION

In a preferred embodiment, a shield contact spring having a contact spring for the purpose of contacting a shield of a cable being connected, and having a fixing spring for the purpose of fixing the shield contact spring in a position in which the contact spring abuts the shield of the cable being connected, wherein the contact spring has a first end and a second end, and wherein the fixing spring has a first end and second end, wherein the contact spring and the fixing spring are connected to each other on their first ends via a U-shaped connection region, is characterized in that the shield contact spring has a support spring for the purpose of pressing out the contact spring from the insertion region of the cable being connected, when the shield contact spring is inserted into a housing. The support spring therefore functions such that the contact spring does not inhibit the insertion of the cable upon the insertion of the cable, the same being connected, into the insertion region, such that a simpler use of the shield contact spring is enabled. The support spring particularly ensures that the contact spring is held in the open state of the shield contact spring out of the insertion region of the cable being connected.

In another preferred embodiment, the disclosed shield contact spring wherein the support spring is preferably arranged on the fixing spring, thereby particularly enabling a pretensioning of the shield contact spring in a simple manner, and particularly also for the purpose of enabling a good contact of the fixing spring to a surrounding shield housing.

In another preferred embodiment, the disclosed shield contact spring, wherein the support spring particularly preferably projects into the space between the contact spring and the fixing spring, particularly to enable a support of the shield contact spring on the housing upon the insertion of the shield contact spring into the housing, in a simple manner, and particularly to not enlarge the constructed space of the shield contact spring.

In another preferred embodiment, the disclosed shield contact spring, wherein the support spring has a first end and a second end, wherein the first end of the support spring is arranged closer to the second end of the fixing spring than the second end of the support spring, and the second end of the support spring is arranged closer to the first end of the fixing spring than the first end of the support spring. In this way, the support spring is particularly arranged running opposite to the fixing spring. In this way, the configuration achieves, in a particularly simple manner, a configuration wherein the shield contact spring holds the open position.

In another preferred embodiment, the disclosed shield contact spring, wherein the support spring is arranged on the fixing spring, and particularly is stamped out of the same and subsequently bent from the same, thereby enabling a cost-effective production process.

In another preferred embodiment, the disclosed shield contact spring, wherein the shield contact spring is preferably designed as a single piece, particularly as a stamp-bend element, in order to make it possible to produce the entire shield contact spring in a cost-effective manner.

In another preferred embodiment, a plug connector comprising one or more shield contact springs as disclosed, and preferably two such shield contact springs, wherein the two shield contact springs are preferably arranged diametrically opposed on the longitudinal axis of the plug connector, in order to achieve the greatest possible contact between the contact spring and the shield of the cable being connected.

In another preferred embodiment, the disclosed plug connector, further comprising wherein a housing is included which has a bearing pin, wherein the shield contact spring is arranged thereon by its connection region and is mounted so as to be able to pivot, and wherein the contact spring is arranged in the interior of the housing, and the fixing spring is arranged on the exterior of the housing. In this manner, the shield contact spring can be operated by the user in an easily-accessible manner.

In another preferred embodiment, the disclosed plug connector wherein the support spring is preferably supported on the outer side of the housing, in order to achieve a configuration, in a simple manner, wherein the shield contact spring in the opened state is arranged in such a manner that the contact spring is held outside of the insertion region of the cable being connected.

In another preferred embodiment, the disclosed plug connector wherein such plug connector is designed as a circular plug connector, particularly as an M-type plug connector [British Standard 546].

DETAILED DESCRIPTION OF THE INVENTION

Figure 1:
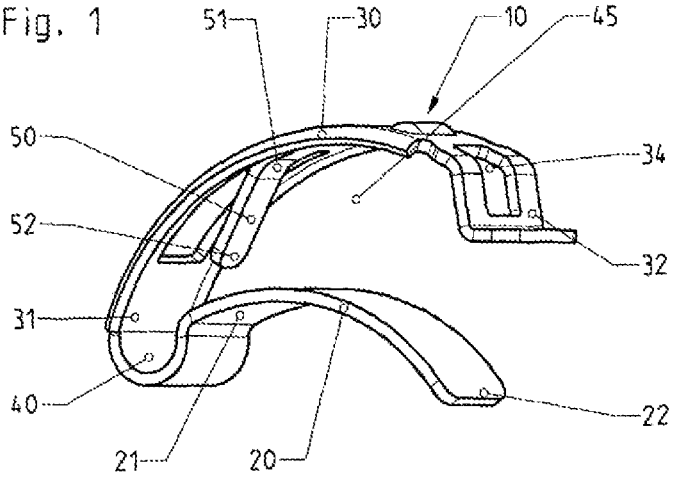
FIG. 1 is a line drawing evidencing a perspective view of one embodiment of a shield contact spring according to the invention.

Referring now to the Figures, FIG. 1 shows a perspective view of one embodiment of a shield contact spring 10, having a contact spring 20 and a fixing spring 30. The contact spring 20 has a first end 21 and a second end 22. The fixing spring 30 has a first end 31 and a second end 32. The contact spring 20 and the fixing spring 30 are connected to each other via a connection region 40 which is substantially U-shaped. The connection region 40 in this case is substantially designed as a section of a sheath, wherein the sheath overlaps an angle of somewhat more than 180°. As such, the contact spring 20 and the fixing spring 30 particularly run approximately in the same direction. Both the fixing spring 30 and the contact spring 20 are designed as curved, and particularly curved in the same direction.

A latch opening 34, the function of which will be described below in greater detail, is arranged in the region of the second end 32 of the fixing spring 30.

In addition, a support spring 50 is arranged on the fixing spring 30. The support spring 50 has a first end 51 and a second end 52, and is arranged on the fixing spring 30 by its first end 51. The first end 51 of the support spring 50 is arranged closer to the second end 32 of the fixing spring 30 than the first end 51 of the support spring 50, while the second end 52 of the support spring 50 is arranged closer to the first end 31 of the fixing spring 30 than the first end 51 of the support spring 50. The support spring 50 is therefore particularly designed as running opposite to the fixing spring 30. In this case, the support spring 50 is arranged on the fixing spring 30 particularly as a single piece, and is particularly stamped out of the fixing spring 30. The support spring 50 is bent off of the fixing spring 30 into a space 45 between the contact spring 20 and the fixing spring 30.

The shield contact spring 10 is produced from an electrically conductive material, and preferably is designed as a stamp-bend element in order to enable a cost-effective production thereof.

Figure 2:
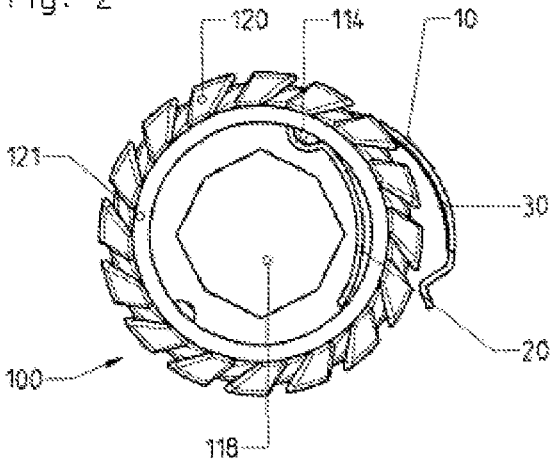
FIG. 2 is a line drawing evidencing a view of the insertion area of a plug connector having a shield contact spring according to FIG. 1, in the open position.
Figure 3:
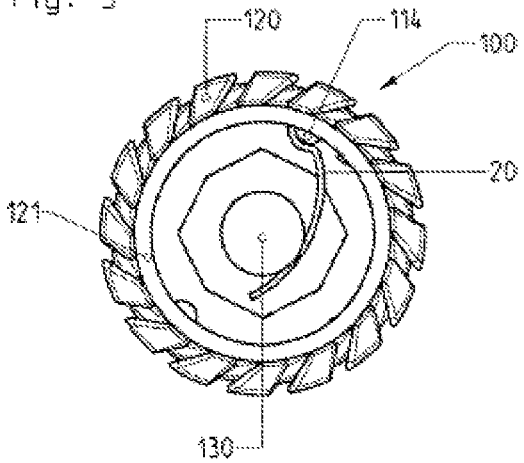
FIG. 3 is a line drawing evidencing the plug connector according to FIG. 2, having the plug contact spring in the closed position.
Figure 4:
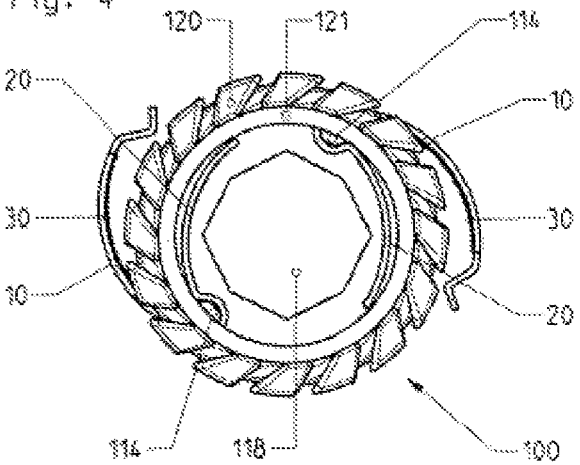
FIG. 4 is a line drawing evidencing a view of the insertion region of a plug connector having two shield contact springs according to FIG. 1, in the open position.
Figure 5:
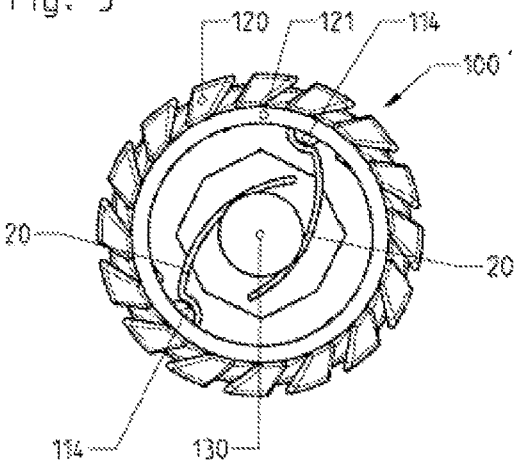
FIG. 5 is a line drawing evidencing the plug connector according to FIG. 4, having the two shield contact springs in the closed position.

FIGS. 2 and 3 show a first embodiment of a plug connector 100 having a shield contact spring 10 according to FIG. 1. FIGS. 4 to 7 show a second embodiment of a plug connector 100' which only differs from the first embodiment of the plug connector 100 in that two shield contact springs 10 as in FIG. 1 are included. The use of not only one shield contact spring 10 as shown in FIG. 1, but rather two shield contact springs 10 as shown in FIG. 1, enables the greatest possible contact surface area for the shield of the cable 130. In this case, the two shield contact springs 10 are preferably arranged diametrically opposite each other, particularly on either side of the insertion region 118 (cf. FIGS. 4 to 7).

Both the plug connector 100 and the plug connector 100' have a housing 110 with an inner wall 111 and an outer wall 112 (cf. particularly FIGS. 6 and 7), wherein at least one recess is arranged in the wall of the housing 110, in which a bearing pin 114 is arranged parallel to the longitudinal axis of the housing 110. Both the shield contact spring 10 as in the first embodiment and the two shield contact springs as in the second embodiment are arranged in the housing 110 in such a manner that the fixing spring 30 is arranged outside of the housing 110, while the contact spring 20 is arranged in the interior of the housing 110. In this case, the shield contact spring 10 is arranged on the bearing pin 114 by the connection region 40 of the shield contact spring 10, and particularly is able to pivot about said bearing pin 114. In this case, the shield contact spring 10 is particularly latched onto the bearing pin 114 by the connection region 40, which is possible because the connection region 40 encloses an angular range of more than 180°.

Figure 6:
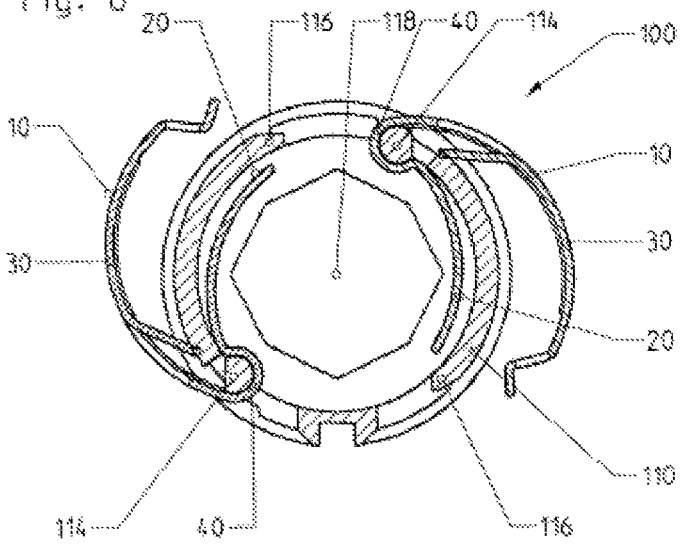
FIG. 6 is a line drawing evidencing a cross-section through the plug connector in FIG. 4.

The support spring 50 is likewise arranged outside of the housing 110 and is supported on its second end 52 by the outer wall 112 of the housing 110 (cf. particularly FIG. 6).

A cable 130 is inserted into the interior of the housing 110 in an insertion region 118. The support spring 50 functions such that the contact spring 20 is held outside of the insertion region 118 when the shield contact spring 10 (cf. FIGS. 2, 4, and 6) is in the open position, because the fixing spring 30 is pressed away from the outer housing wall 112 by the support spring 50, and therefore the contact spring 20 is particularly substantially pressed against the inner wall 111 of the housing 110. The support spring 50 is particularly designed in such a manner that the shield contact spring 10 is held against the housing 110 under pretension. After the cable 130 has been inserted into the insertion region 118 of the plug connector 100, the fixing spring 30 is pivoted against the force of the supporting spring 50, until the latch opening 34 of the fixing spring 30 latches to a latch element 116 arranged on the housing 110 (cf. particularly FIG. 7). In this case, the contact spring 20 is pivoted from the inner wall 111 of the housing 110 into the insertion region 118, and can contact the shield of the cable 130 (cf. FIGS. 3, 5, and 7). The curve of the fixing spring 30 enables a space-saving abutment of the fixing spring 30 on the outer wall 112 of the housing 110. The curve of the contact spring 20 enables a space-saving abutment of the contact spring 20 on the inner wall 111 of the housing when in the open position, such that the contact spring 20 inhibits the insertion of the cable 130 as little as possible, and enables a contact to the shield of the cable 130 over a large surface when in the closed position.

Figure 7:
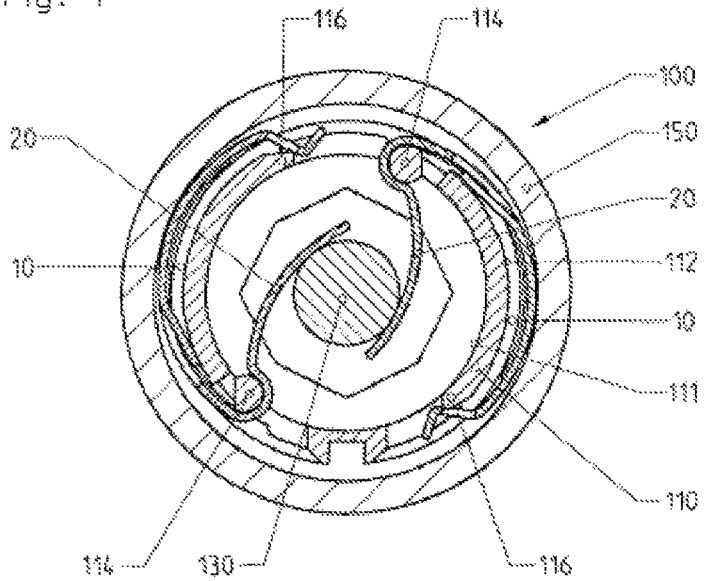
FIG. 7 is a line drawing evidencing a cross-section through the plug connector in FIG. 5.

After the closing of the single shield contact spring 10 as in the first embodiment, or after the closing of the two shield contact springs 10 as in the second embodiment, a shield housing 150 of the plug connector 100, 100' is slid over the housing 110 (cf. FIG. 7). The latching of the latch element 116 is designed in such a manner that it has some play. As such, the single shield contact spring 10 or both of the single shield contact springs 10 are pressed outward by the force of the support spring 50. After the shield housing 150 is slid over the housing 110, the force of the support spring 50 presses the single shield contact spring 10 or the two single shield contact springs 10 on the inner side of the shield housing 150, such that a good electrically conductive contact is created between the fixing spring 30 and the shield housing 150, and in general between the shield housing 150 and the shield of the cable 130. As an alternative, rather than an additional shield housing 150, the shield can also be integrated into the bearing pin 114.

In addition, FIGS. 2 to 7 further show a compression cage 120 of the threaded cable connection on the plug connector 100, 100', and a seal 121, although these are not significant for the invention.

LIST OF REFERENCE NUMBERS

10 shield contact spring
20 contact spring
21 first end
22 second end
30 fixing spring
31 first end
32 second end
34 latch opening
40 connection region
45 space
50 support spring
51 first end
52 second end
100 plug connection
100' plug connection
111 inner wall
112 outer wall
114 bearing pin
116 latch element
118 insertion region
120 compression cage
121 seal
130 cable
150 shield housing The references recited herein are incorporated herein in their entirety, particularly as they relate to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable Equivalents.

We claim:

1. A shield contact spring comprising a contact spring for the purpose of contacting a shield of a cable, the same being connected, and a fixing spring for the purpose of fixing the shield contact spring in a position in which the contact spring abuts the shield of the cable being connected, wherein the contact spring has a first end and a second end, and wherein the fixing spring has a first end and a second end, wherein the contact spring and the fixing spring are connected to each other on their first ends via a U-shaped connection region, characterized in that the shield contact spring has a support spring for the purpose of pressing out the contact spring from an insertion region of the cable being connected, upon the insertion of the shield contact spring in a housing; wherein the shield contact spring is oriented perpendicularly to the cable.

2. The shield contact spring of claim 1, wherein the support spring is arranged on the fixing spring.

3. The shield contact spring of claim 1, further comprising wherein the support spring projects into a space between the contact spring and the fixing spring.

4. The shield contact spring of claim 1, further comprising wherein the support spring has a first end and a second end, wherein the first end of the support spring is arranged closer to the second end of the fixing spring than the second end of the support spring, and the second end of the support spring is arranged closer to the first end of the fixing spring than the first end of the support spring.

5. The shield contact spring of claim 1, wherein the support spring is arranged on the fixing spring (30) as a single piece, and is particularly stamped out of the same and subsequently bent into place.

6. The shield contact spring of claim 1, wherein the shield contact spring is designed as a single piece, particularly as a stamp-bend element.

7. A plug connector comprising one or more shield contact spring according to claim 1, wherein the one or more shield contact springs are diametrically opposite each other.

8. The plug connector of claim 7, further comprising wherein the plug connector has a housing which has a bearing pin on which the shield contact spring is arranged by its connection region in a manner allowing pivoting, wherein the contact spring is arranged on the interior of the housing and the fixing spring is arranged on the outside of the housing.

9. The plug connector of claim 8, wherein the support spring is supported on the outer wall of the housing.

10. The plug connector of claim 7, wherein the plug connector is designed as a round plug connector, particularly as an M-type plug connector.

* * * * *